US012677866B2

(12) United States Patent
Deppe et al.

(10) Patent No.: US 12,677,866 B2
(45) Date of Patent: Jul. 14, 2026

(54) ARRANGEMENT FOR TRANSVERSELY AXIALLY CONVEYING OF ROD-SHAPED ARTICLES OF THE TOBACCO PROCESSING INDUSTRY

(71) Applicant: Körber Technologies GmbH, Hamburg (DE)

(72) Inventors: Oliver Deppe, Hamburg (DE); Thomas Meins, Labenz (DE); Daniel Diedrich, Hamburg (DE); Marcus Wagner, Hamburg (DE); Bastian Wolff, Hamburg (DE)

(73) Assignee: Körber Technologies GmbH, Hamburg (DE)

( * ) Notice: Subject to any disclaimer, the term of this patent is extended or adjusted under 35 U.S.C. 154(b) by 488 days.

(21) Appl. No.: 18/198,050

(22) Filed: May 16, 2023

(65) Prior Publication Data

US 2023/0371579 A1 Nov. 23, 2023

(30) Foreign Application Priority Data

May 18, 2022 (DE) ..... 10 2022 112 419.3

(51) Int. Cl.
*A24C 5/32* (2006.01)
*A24C 5/34* (2006.01)

(52) U.S. Cl.
CPC ..... *A24C 5/326* (2013.01); *A24C 5/327* (2013.01); *A24C 5/34* (2013.01)

(58) Field of Classification Search
None
See application file for complete search history.

(56) References Cited

U.S. PATENT DOCUMENTS 5,135,008 A 8/1992 Oesterling et al.
2023/0011982 A1 1/2023 Cali et al.

FOREIGN PATENT DOCUMENTS

DE 4008475 9/1991
DE 10 2020 106 444 5/2020

(Continued)

OTHER PUBLICATIONS

Jarad et al. EP 2918180 A1 English Machine Translation (Year: 2015).*

(Continued)

*Primary Examiner* — Michael H. Wilson
*Assistant Examiner* — Daniel Edward Vakili
(74) *Attorney, Agent, or Firm* — GREENBLUM & BERNSTEIN, P.L.C.

(57) ABSTRACT

An arrangement and method for conveying rod-shaped articles of the tobacco-processing industry. The arrangement conveys article segments of first and second rows disposed side by side in pairs in a transverse axial direction. In a conveying inspection section, at least one conveying member conveys a first row of article segments disposed transversely axially behind each other and conveys a second row of article segments disposed transversely axially behind each other. Moreover, one or two head end inspection devices, preferably optical, are provided for inspecting one or both head ends of the first row of article segments along a conveyor path for the first row of article segments of the first row, and one or two head end inspection device, preferably optical, are provided for inspecting one or both head ends of the second row of article segments along a conveyor path for the second row of article segments.

18 Claims, 10 Drawing Sheets

(56) References Cited

FOREIGN PATENT DOCUMENTS

| | | | | |
|---|---|---|---|---|
| DE | 10 2022 101 392.8 | | 7/2023 | |
| EP | 1 691 633 | | 9/2009 | |
| EP | 2918180 | | 9/2015 | |
| EP | 2918180 | A1 * | 9/2015 | ..... A24C 5/3412 |
| EP | 3520631 | | 8/2019 | |
| EP | 3 685 684 | | 7/2020 | |
| EP | 3520631 | B1 * | 11/2020 | ..... A24D 3/0295 |
| WO | 2021/121790 | | 6/2021 | |
| WO | 2021/214657 | | 10/2021 | |
| WO | 2022/008220 | | 1/2022 | |

OTHER PUBLICATIONS

Extended European Search Report conducted in counterpart Europe Appln. No. 23 17 2827 (Oct. 2, 2023).

* cited by examiner

ARRANGEMENT FOR TRANSVERSELY AXIALLY CONVEYING OF ROD-SHAPED ARTICLES OF THE TOBACCO PROCESSING INDUSTRY

CROSS-REFERENCE TO RELATED APPLICATION

This application claims priority under 35 U.S.C. § 119(a) to German Application No. 10 2022 112 419.3 filed May 18, 2022, the disclosure of which is expressly incorporated by reference herein in its entirety.

BACKGROUND

1. Field of the Invention

Embodiments relate to an arrangement for transversely axially conveying of rod-shaped articles of the tobacco-processing industry, in particular filter rods or rod-shaped segments. The embodiments further relate to a method for transversely axially conveying of rod-shaped articles of the tobacco-processing industry, in particular filter rods or filter rod segments or segment articles or multi-segment articles.

2. Discussion of Background Information

For manufacturing multi-segment articles of the tobacco-processing industry, various rod-shaped segments, in the shape of base rods or strand portions, are provided and assembled to a rod-shaped multi-segment article by a drum machine.

It is known from the prior art to manufacture base rods and to feed them to the processing process of the drum machine by feeding modules or to connect the drum machine directly to a rod machine in order to further process portions directly.

EP 1 691 633 B1 discloses, for example, a drum machine of the tobacco-processing industry for manufacturing multi-segment articles, the drum machine including a plurality of feeding modules which provide rod-shaped segments and feed them to a transport line.

SUMMARY

Embodiments provide inspected segment articles in a simple manner, for example, for a multi-segment article manufacturing machine of the tobacco-processing industry.

According to embodiments, an arrangement for transversely axially conveying of rod-shaped articles of the tobacco-processing industry, in particular filter rods or filter rod segments or segment articles or multi-segment articles is provided. The arrangement is configured to convey article segments of a first row and a second row disposed side by side in pairs in transverse axial direction. In a conveying inspection section, the arrangement has at least one conveying member or a plurality of conveying members for a first row of article segments transversely axially disposed behind each other and for a second row of article segments transversely axially disposed behind each other. Moreover, in the conveying inspection section, the conveying member is configured or the conveying members are configured so that the article segments of the first row are conveyed or conveyable along a conveyor path for the article segments of the first row, and the conveying member is configured or the conveying members are configured so that the article segments of the second row are conveyed or conveyable along a conveyor path for the article segments of the second row. In each case one, in particular optical, head end inspection device or two, in particular optical, head end inspection devices for the two head ends of the article segments of the first row are provided along the conveyor path for the article segments of the first row, and in each case one, in particular optical, head end inspection device or two, in particular optical, head end inspection devices for the two head ends of the article segments of the second row are provided along the conveyor path for the article segments of the second row. A conveying member, in particular a conveyor drum, is provided in the transverse axial conveying direction of the article segments downstream of the conveying inspection section and/or downstream of the head end inspection device or devices for the article segments of the first row and the head end inspection device or devices for the article segments of the second row, wherein the conveying member is configured to convey pairs of article segments assembled in each case of one article segment of the first row and in each case of one article segment of the second row.

Embodiments are based on the idea that, for example, from a rod machine for manufacturing a rod of aerosol-forming materials, in particular from reconstituted tobacco-containing film, using the arrangement, the head ends of the two webs or rows of the article segments are inspected by the head end inspection devices, preferably individually. During the conversion of the articles or article segments manufactured on the rod machine, the rod-shaped articles or article segments are conveyed by multiple conveyor drums in the transverse axial direction in the arrangement. On the output side of the arrangement are provided respectively pairs of article segments assembled of one article segment of the first row, respectively, and one article segment of the second row, respectively, for further processing in a multi-segment article manufacturing machine.

During the conveying of the article rods taken from the rod machine, the article rods conveyed transversely axially are cut, for example, into rod-shaped article segments, wherein the cut rod-shaped article segments are conveyed in two rows of article segments disposed side by side in the receiving troughs of the conveyor drums of the arrangement. The pairs of article segments, each including an article segment of a first row and of a second row, which are disposed in the receiving troughs in the longitudinal axial direction of the article segments behind each other or side by side, are inspected in the arrangement upon conveying. Here, the two head ends or face sides of the respective article segments are inspected by one or more corresponding head end inspection devices.

In particular, the rod-shaped article segments include magnetic or magnetizable material, in particular one, in particular flat, metal band, which is disposed in the interior of the article segments. Thereby, the magnetic or magnetizable or inductively heatable material is preferably a metal band, which can be heated by induction in a finished product, such as a multi-segment article, so that, for example, tobacco material provided in the rod-shaped multi-segment article is heated.

For example, inspection devices are designed to inspect the face surface of the head ends or a region of the head ends of the article segments. By way of example, such a head end inspection device for face sides of rod-shaped (multi-segment) articles is described in DE 10 2020 106 444 A1, the disclosure of which is incorporated by reference herein in its entirety. In particular, the head end inspection devices include, preferably each, a polarization camera.

In order to inspect the article segments of the first row and of the second row disposed side by side in receiving troughs of conveyor drums of the arrangement, embodiments include the article segments of the first row and the article segments of the second row being conveyed to the head end inspection devices on different conveyor paths within the conveying inspection section in the arrangement, so that the mutually facing head ends and/or face sides of the article segments of the first row and of the article segments of the second row as well as the outer lying head ends of the article segments are inspected. Here, the article segments of both rows are conveyed to the head end inspection devices on different conveyor paths within the arrangement, so that in each case one head end inspection device inspects the head end facing the head end inspection device on both sides of the article segments of the first type and on both sides of the article segments of the second type.

After the inspection of the head ends of the article segments of the first row and of the article segments of the second row, the article segments of both rows are again brought together to pairs in the arrangement, so that pairs of article segments are provided for the further processing of the article segments, for example, on a multi-segment manufacturing machine. The pairs of article segments are each assembled of an article segment of the first row and of the second row.

Preferably, the inspection of the head ends of the article segments of the first row and the inspection of the head ends of the article segments of the second row are performed independently of each another.

Moreover, it is possible within the scope of the embodiments, that article segments, for example, provided with a metal band are aligned in the arrangement prior to the inspection of the head ends, so that the metal band assumes a predetermined position in the receiving troughs of the conveyor drums of the arrangement.

In addition, it is foreseen, that for the inspection of the head ends of the article segments of the first row and of the article segments of the second row, the two article segments of the two rows disposed side by side are not spaced or spread apart longitudinally axially from each another. For this purpose, in one configuration the arrangement preferably does not comprise a spreading drum or the like.

In the case of the article segments of a first row and a second row disposed side by side in pairs being conveyed in the transverse axial direction, within the scope of the invention, preferably, in each case pairs are formed from an article segment of the first row and an article segment of the second row. In particular, each of the article segments of the first row and the article segments of the second row are disposed in rows transversely axially behind each other.

For this purpose, according to a further development of the arrangement, there is provided at least an upstream conveying member, in particular a conveyor drum, ahead of the start of the conveyor path for the article segments of the first row for an inspection of the head ends and ahead of the start of the conveyor path for the article segments of the second row for an inspection of the head ends, in particular with respect to the conveying direction of the article segments ahead of the conveying inspection section, the at least one conveying member being configured, to convey transversely axially pairs of article segments disposed side by side assembled of an article segment of the first row, respectively, and of an article segment of the second row, respectively. Thereby, with respect to the conveying direction of the article segments upstream of the conveying inspection section, and thus ahead of the start of the conveyor path for the article segments of the first row for inspection of the head ends and ahead of the start of the conveyor path for the article segments of the second row, the at least one conveying member, in particular conveyor drum, is disposed, in order to convey the pairs of article segments disposed side by side assembled of an article segment of the first row, respectively, and an article segment of the second row, respectively, to the conveying inspection section.

Here, the pairs of article segments are disposed behind each other in the transverse axial direction, for example, in receiving troughs of the conveyor drums.

Furthermore, in one embodiment, the arrangement is distinguished in that in the conveying inspection section, the article segments of the first row are conveyed or conveyable on a first conveying member, in particular conveyor drum, wherein one or two, in particular optical, head end inspection devices for the head ends of the article segments of the first row are disposed on the first conveying member, and in the conveying inspection section, the article segments of the second row are conveyed or conveyable on a further conveying member, in particular conveyor drum, wherein one or two, in particular optical, head end inspection devices for the head ends of the article segments of the second row are disposed on the further conveying member.

Here, for the inspection of the head ends of the article segments of the two rows, separate conveying members or conveyor drums are provided in one embodiment, on which one head end inspection device or two head end inspection devices are provided, respectively, for the two head ends of the article segments in order to inspect the head ends of the article segments. Here, the article segments of the two rows are divided into two partial streams for the inspection, wherein an inspection of the head ends of the article segments is carried out for each partial stream. In particular, the article segments to be inspected or inspected are not moved longitudinally axially in the receiving troughs of the conveyor drums in the conveying inspection section.

According to an advantageous embodiment, the arrangement is further developed, in that at least one common conveying member, in particular a conveyor drum, is provided in the conveying inspection section for the article segments of the first row and for the article segments of the second row, wherein the common conveying member is configured such, that, after receiving pairs of article segments assembled respectively of an article segment of the first row and of an article segment of the second row, the article segments of the first row are moved or moveable to each other relative to the article segments of the second row, preferably by maintaining the transverse axial conveying direction, and wherein one or two head end inspection devices for the article segments of a row are provided on the common conveying member or wherein in each case one or two head end inspection devices for the article segments of the first row and in each case two head end inspection devices for the article segments of the second row are provided on the common conveying member.

Due to the fact, that the article segments of the two rows, which are preferably disposed side by side in the receiving troughs of the common conveying members or conveyor drum upon transfer, are moved against each other during the conveying on the common conveying member, the mutually facing face sides or head ends of the article segments are spaced apart from each other, so that the two mutually facing head ends of the article segments are accessible to an inspection by a head end inspection device. Here, for example, it is provided, that the article segments of the two rows are moved, in particular accelerated or decelerated, using, for example, levers or rods or the like, wherein, here, in particular, the levers or rods are designed with corresponding receptacles for the article segments.

Moreover, within the scope of the invention, it is also provided that the article segments of the two rows are moved relative to each other on the common conveying member, in particular conveyor drum, by lowering or lifting the article segments in the radial direction, for example by using movable receiving troughs. Here, the receiving troughs are moved, for example, by a control cam, lifting cam or the like during the transverse axial conveying on the conveying member or the conveyor drum.

In one configuration of the arrangement, it is preferably provided that the common conveying member is designed as conveyor drum and the conveyor drum is configured to move the article segments of the first row in the radial direction and/or in the circumferential direction of the conveyor drum relative to the article segments of the second row.

Here, it is in particular provided that upon transfer of the article segments in the receiving troughs of the common conveyor drum the article segments of the first row and of the second row (as a pair) are not displaced, i.e., that the central longitudinal axes of the article segments of the first row and the central longitudinal axis of the article segments of the second row are aligned collinearly with each other. Thereby, the center longitudinal axes of the article segments of the first row and the center longitudinal axis of the article segments of the second row are aligned or disposed along a common longitudinal axis. Likewise, upon the release of the article segments and after the inspection of the head ends, the center longitudinal axes of the article segments of the first row and of the second row are aligned collinearly on the conveyor drum. During the conveying of the article segments on the conveyor drum the article segments are moved such, that the central longitudinal axes of the article segments of an article segment pair are aligned parallel to each other, here, the article segments of the two rows being moved relative to each other.

In addition, in the case of the arrangement in one embodiment, it is preferred that the common conveying member is designed as conveyor drum with movable or moving, in particular pivotable, tiny arms for the article segments. Thereby, the tiny arms are preferably designed with corresponding receiving troughs for the respective article segments.

Thereby, according to a further embodiment of the arrangement, it is provided that the conveyor drum for the article segments is designed such that during the conveying of the article segments by the conveyor drum, the article segments of the first row and the article segments of the second row of the transferred pairs of the article segments are spaced apart from each other, preferably in the transverse axial direction.

Furthermore, it is preferred that the common conveying member is designed as a conveyor drum with rotatable receptacles for the article segments, wherein in particular the rotatable receptacles are rotatable about the rotational axis oriented radially to the rotational axis of the conveyor drum. Due to the rotation of the article segments by a predetermined angle about a rotational axis designed perpendicular to their longitudinal axis it is possible for the article segments to be rotated or turned or reoriented by a predetermined angle during their conveying on the conveyor drum, for example on a rotating body, whereby the mutually facing head ends of the article segments of the two rows are spaced apart from each other, whereby the mutually facing head ends of the article segments are accessible to a head end inspection by a head end inspection device. Thereby, for example, it is possible for the article segments of the two rows to be provided with pivotable receiving troughs for the article segments, respectively.

According to a further advantageous embodiment, the arrangement is further developed in that relative to the transverse axial conveying direction of the article segments a first staggered drum for the article segments of the first row and for the article segments of the second row and a second staggered drum for the article segments disposed in a staggered manner are provided in the conveying inspection section, wherein at least one conveyor drum with at least one or at least two head end inspection devices for the article segments of a row are provided between the first staggered drum and the second staggered drum, or wherein a conveyor drum is provided with one or two head end inspection devices for the article segments of the first row and with one or two head end inspection devices for the article segments of the second row. Here, the inspection of the head ends takes place on the conveyor drum between the two staggered drums for the article segments disposed in a staggered manner by the head end inspection devices. Subsequently, the inspected article segments are transferred to the following second staggered drum, so that the article segments transferred in a staggered manner are staggered back, whereby after that pairs of article segments, each assembled of an article segment of the first row and an article segment of the second row, are conveyed, for example to a multi-segment article manufacturing machine.

Furthermore, an embodiment of the arrangement in one configuration is distinguished in that in the conveying inspection section is provided a common conveyor drum for pairs of article segments, each composed of an article segment of the first row and an article segment of the second row, wherein, at first, pairs of article segments are conveyed or conveyable on the common conveyor drum, wherein a first conveyor drum for the article segments of the first row and a second conveyor drum for the article segments of the second row are disposed on the common conveyor drum, wherein article segments of the first row are transferred or transferable from the common conveyor drum to the first conveyor drum, and the head ends of the article segments of the first row conveyed by the first conveyor drum are inspected or inspectable by one or two head end inspection devices disposed on the first conveyor drum, and, after the inspection of the head ends of the article segments of the first row, the article segments of the first row are transferred or transferable to the common conveyor drum, and wherein, after that, article segments of the second row are transferred or transferable from the common conveyor drum to the second conveyor drum, and the head ends of the article segments of the second row conveyed by the second conveyor drum are inspected or inspectable by one or two head end inspection devices disposed on the first conveyor drum, and, after the inspection of the head ends of the article segments of the second row, the article segments of the second row are transferred or transferable to the common conveyor drum. Here, it is provided that the article segments of a row are taken over and conveyed from the common conveyor drum to a conveyor drum, respectively, wherein the article segments are correspondingly inspected at their head ends on the respective conveyor drum for the article segments. After the inspection of the head ends, the respective article segments of the two rows are transferred back to the common conveyor drum, respectively. Thereby, upon the transfer of the inspected article segments of the two rows from the common conveyor drum to a subsequent conveyor drum, the article segments of the two rows are preferably disposed in receiving troughs of the common conveyor drum such that the longitudinal axes of the article segments of the two rows are aligned collinearly.

In addition, the arrangement in a further development is distinguished in that the arrangement is designed as a transfer module between a rod machine for manufacturing rod-shaped article segments and a multi-segment article manufacturing machine for manufacturing rod-shaped multi-segment articles of the tobacco-processing industry.

Thereby, it is possible for the arrangement to have a transfer device, such as a transfer drum, in order to transfer the rod-shaped article rods manufactured on the rod machine and conveyed transversely axially along the longitudinal axis. Subsequently, within the arrangement or the transfer module, the article rods of multiple length taken-over and transversely axially conveyed can be cut into corresponding article segments. Hereby, in one configuration, the arrangement may comprise a tumbling drum, an orienting drum for orienting the article rods designed, for example, with a metal band, as well as a cutting drum and a staggered drum in the conveying direction. Moreover, the arrangement may also comprise still at least a staggered shifting drum or two staggered shifting drums in the conveying direction of the article segments before the article segments grouped in pairs are inspected in a conveying inspection section by the head end inspection devices. Subsequent to the conveying inspection section, a transfer drum or release drum is provided in order to consecutively transfer the article segments of both rows disposed in pairs to a multi segment article manufacturing machine.

Moreover, the embodiments are directed to a method for transversely axially conveying of rod-shaped articles of the tobacco processing industry, in particular filter rods or filter rod segments or segment articles or multi-segment articles, using an arrangement described above for transversely axially conveying of rod-shaped articles of the tobacco processing industry. In order to avoid repetitions, we correspondingly refer to the above embodiments.

In addition, the embodiments are achieved by a method for transversely axially conveying of rod-shaped articles of the tobacco-processing industry, in particular filter rods or filter rod segments or segment articles or multi-segment articles. The method includes a) providing article segments disposed side by side in pairs forming a first row and a second row of article segments, wherein the article segments include a magnetic or magnetizable or inductively heatable material, designed to heat the article segments, wherein in particular the article segments comprise a single usable length; b) transversely axially conveying of article segments disposed side by side in pairs, forming a first row and a second row of article segments; c) conveying the article segments of the first row along a first conveyor path for the article segments of the first row and conveying the article segments of the second row along a second conveyor path for the article segments of the second row, wherein the article segments of the first row and the second row are spaced apart at least in sections; d) inspecting the two head ends of the article segments of the first row, in particular on the first conveyor path and/or in particular simultaneously or consecutively, and inspecting the two head ends of the article segments of the second row, in particular on the second conveyor path and/or in particular simultaneously or consecutively, in a conveying inspection section; and e) merging pairs of article segments longitudinally axially adjacent disposed contiguously on the face side, assembled of one article segment of the first row and one article segment of the second row respectively, in particular after inspecting one and/or both head ends of the article segments of the first row and in particular after inspecting one and/or both head ends of the article segments of the second row.

Advantageously, the preceding method is carried out by using or by the arrangement described above for transversely axially conveying of rod-shaped articles of the tobacco processing industry. To avoid repetitions, explicit reference is made to the previous embodiments for this.

In the context of the invention, in particular, article segments of a single usable length are understood to be article segments to be processed or processed, which after further processing, e.g., on a multi-segment rod manufacturing machine, have the (useable) length, which they also have in the, in particular consumable, end product. Thereby, the rod-shaped end product is made of several article segments of single usable length.

Further features of the invention will become apparent from the description of the embodiments according to the invention together with the claims and the attached drawings. Embodiments according to the invention may fulfill individual features or a combination of several features.

Embodiments are directed to an arrangement for transversely axially conveying of rod-shaped articles of the tobacco-processing industry, the arrangement includes a conveying inspection section comprising at least one conveying member for conveying a first row of article segments transversely axially disposed behind each other in a transverse axial conveyor direction and for conveying a second row of article segments transversely axially disposed behind each other in the transverse axial conveyor direction, whereby, in the conveying inspection section, the first row of article segments are conveyable along a first conveying path, and the second row of article segments are conveyable along a second conveyor path. At least one first head end inspection device is arranged along the first conveying path for at least one head end of the first row article segments and at least one second head end inspection device is arranged along the second conveying path for at least one head end of the second row of article segments. A further conveying member is arranged, with respect to the transverse axial conveyor direction, after at least one of the conveying inspection section or the first and second head end inspection devices, where the further conveying member is configured to convey article segment pairs that each include one first row article segment and one second row article segment.

According to embodiments, the arrangement can further include at least an upstream conveying member arranged, with respect to the transverse axial conveyor direction, ahead of a start of the first conveying path and ahead of the start of the second conveying path. The at least one upstream conveying member may be configured to transversely axially convey side by side pairs of article segments, which are assembled of a first row article segment and a second row article segment.

In accordance with embodiments, in the conveying inspection section: the first row of article segments can be conveyable on a first conveying member and the at least one first head end inspection device for the at least one head end of the first row of article segments may be disposed on the first conveying member, and the second row of article segments can be conveyable on a second conveying member and the at least one second head end inspection device for the at least one head end of the second row of article segments may be disposed on the second conveying member. The at least one first head end inspection device may include two first head end inspection devices disposed on the first conveying member to inspect opposite head ends of the first row of article segments, and the at least one second head end inspection device can include two second head end inspection devices disposed on the second conveying member to inspect opposite head ends of the second row of article segments.

In other embodiments, the arrangement may further include at least one common conveyor drum in the conveying inspection section for the first row of article segments and for the second row of article segments. The common conveying member can be configured so that, after receiving the side by side pairs of article segments, the first row of the article segments are movable relative to each other and to the second row of article segments, and the least one first head end inspection device can be provided on the common conveying member. Further, the common conveying member can be configured so that, after receiving the side by side pairs of article segments, the first row of the article segments are movable relative to each other and to the second row of article segments while maintaining the transverse axial conveying direction. Still further, the at least one second head end inspection device can include two second head end inspection devices and the two second head end inspection devices are provided on the common conveying member. Further still, the at least one common conveyor drum may be configured to move the first row of article segments in at least one of a radial direction or a circumferential direction of the common conveyor drum relative to the second row of article segments. Moreover, the at least one common conveyor drum may have movable arms for the first row of article segments, and the movable arms for the first row of article segments can be pivotable. Also, the at least one common conveyor drum can be designed so that, when conveying the first and second rows of article segments, the first row of article segments and the second row of article segments are spaced apart from each other in the transverse axial direction. Also, still, the at least one common conveyor drum may include rotatable receptacles for the first and second rows of article segments, the rotatable receptacles being rotatable about rotational axes oriented radially to the rotational axis of the at least one common conveyor drum.

According to other embodiments, the arrangement, in the conveying inspection section, may further include a first staggered drum for the first row of article segments and for the second row of article segments, a second staggered drum for the first and second rows of article segments disposed in a staggered manner relative to the transverse axial conveying direction of the first and second rows of article segments, and at least one conveyor drum, in which, one of: at least one of the at least one first head inspection device or the at least one second head inspection device can be provided between the first staggered drum and the second staggered drum, or the at least one first head inspection device and the at least one second head inspection device can be provided on the at least one conveyor drum.

In accordance with still other embodiment, in the conveying inspection section, the arrangement may further include a common conveyor drum on which pairs of article segments are conveyable, wherein each pair of article segments is assembled of a first row article segment and a second row article segment, a first conveyor drum for the first row of article segments, and a second conveyor drum for the second row of article segments are disposed on the common conveyor drum. The first row of article segments can be transferable from the common conveyor drum to the first conveyor drum for further conveyance, head ends of the first row of article segments may be further conveyed by the first conveyor drum past the at least one first head end inspection devices, which is disposed on the first conveyor drum, for inspection, and, after passing the at least one first head end inspection device, the first row of article segments can be transferable to the common conveyor drum. With respect to the lateral axial direction, downstream of the first conveyor, the second row of article segments can be transferable from the common conveyor drum to the second conveyor drum for further conveyance, head ends of the second row of article segments may be further conveyed by the second conveyor drum past the at least one second head end inspection device, which is disposed on the second conveyor drum, for inspection, and, after passing the at least one second head end inspection device, the second row of article segments can be transferable to the common conveyor drum.

In other embodiments, the arrangement may be designed as a transfer module between a rod machine for manufacturing rod-shaped article segments and a multi-segment article manufacturing machine for manufacturing rod-shaped multi-segment articles of the tobacco-processing industry.

In accordance with embodiments, the rod-shaped articles of the tobacco processing industry can include one of filter rods or filter rod segments or segment articles or multi-segment articles.

According to still other embodiments, at least one of the at least one first head end inspection device and the at least one second head end inspection device may include an optical sensor.

Embodiments are directed to a method for transversely axially conveying rod-shaped articles of the tobacco-processing industry in the above described embodiments of the arrangement. The method can include conveying a first row of article segments transversely axially disposed behind each other in a transverse axial conveyor direction along a first conveying path in a conveying inspection section and a second row of article segments transversely axially disposed behind each other in the transverse axial conveyor direction along a second conveyor path in the conveying inspection section. At least one first head end inspection device can be arranged along the first conveying path for inspecting at least one head end of the first row article segments and at least one second head end inspection device may be arranged along the second conveying path for inspecting at least one head end of the second row of article segments. Downstream of at least one of the conveying inspection section or the at least one first and at least one second head end inspection devices, the method can further include conveying article segment pairs that each include one first row article segment and one second row article segment.

Embodiments are directed to a method for transversely axially conveying of rod-shaped articles of the tobacco-processing industry. The method includes providing article segments disposed side by side in pairs that form a first row of article segments and a second row of article segments. The article segments include one of a magnetic, a magnetizable or an inductively heatable material that is designed to heat the article segments and the article segments include a single usable length. The method also includes transversely axially conveying of article segments disposed side by side in pairs, forming a first row and a second row of article segments, conveying the first row of article segments along a first conveyor path and conveying the second row of article segments along a second conveyor path so that the first row of article segments are spaced at least in sections from the second row of article segments, inspecting, in a conveying inspection section, at least one head end of the first row of article segments on the first conveyor path one of simultaneously or consecutively and inspecting at least one head end of the second row of article segments on the second conveyor path one of simultaneously or consecutively; and after the inspecting, merging pairs of article segments that are longitudinally axially adjacent and disposed contiguously on a front side, the pairs of article segments being assembled of one first row article segment and one second row article segment.

In accordance with still yet other embodiments, the rod-shaped articles of the tobacco processing industry can include one of filter rods or filter rod segments or segment articles or multi-segment articles.

Other exemplary embodiments and advantages of the present invention may be ascertained by reviewing the present disclosure and the accompanying drawing.

BRIEF DESCRIPTION OF THE DRAWINGS

The invention will be described below without restricting the general inventive idea on the basis of exemplary embodiments with reference to the drawings, whereby we expressly refer to the drawings with regard to all details according to the invention that are not explained in greater detail in the text. In the drawings, the same or similar types of elements and/or parts are provided with the same reference numbers so that a corresponding re-introduction can be omitted. Moreover, the drawings show.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the context of the invention, features being identified with "in particular" or "preferably" are to be understood as optional features.

Figure 1A:
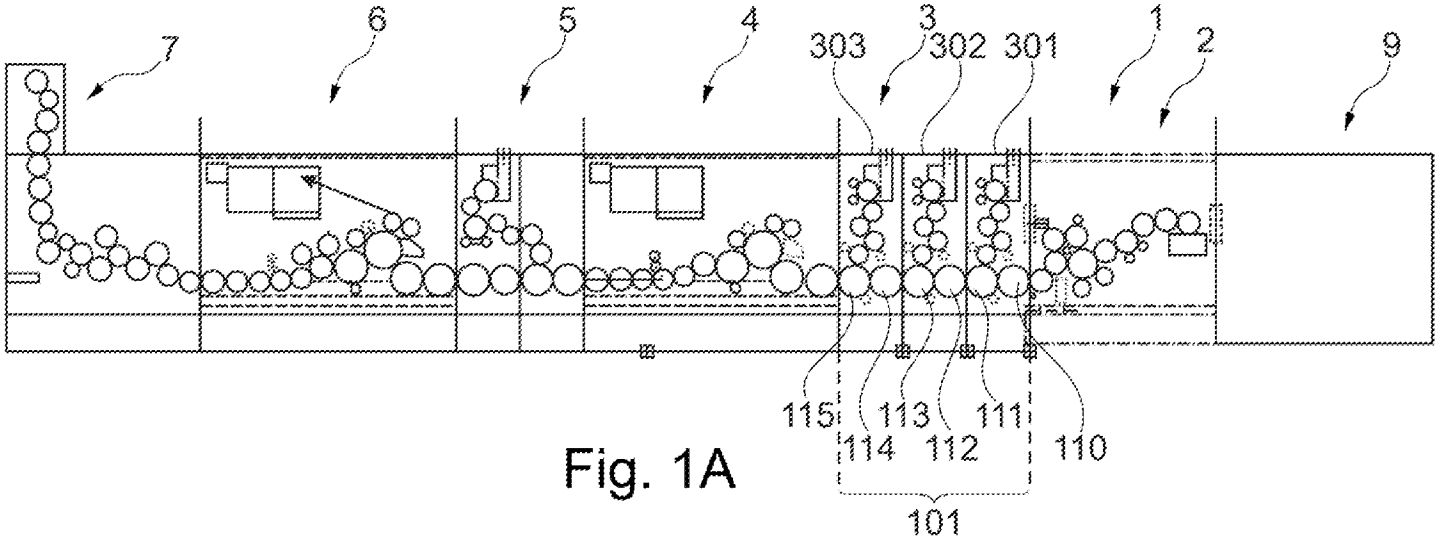
FIG. 1A schematically shows a view of a machine of the tobacco-processing industry for manufacturing of multi-segment articles.
Figure 1B:
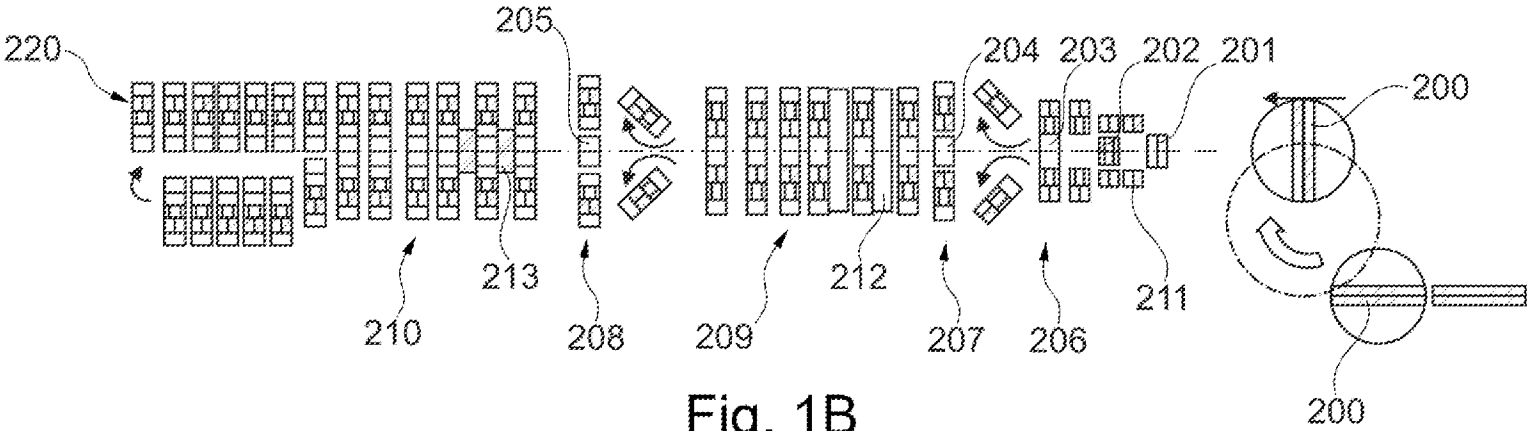
FIG. 1B schematically shows the process flow associated with FIG. 1A.

FIG. 1A shows a schematic view of a (drum) machine 1 of the tobacco processing industry for manufacturing of multi-segment articles, which is coupled to a rod machine 9, for example a crimper for manufacturing a rod of aerosol-forming material, in particular from reconstituted tobacco-containing film.

The article rod manufactured in rod machine 9 is wrapped with a wrapping material, for example a wrapping paper, and cut to length by a cutting unit in, preferably aerosol-forming, multi-length article segments 200. The segments 200 cut to length are transferred via a transfer drum (cf., for example, FIG. 2, reference sign 21) to a transfer module 2 of the machine 1, on which the multi-length segments 200 are divided into two single-length segments 201 and the face surfaces of each (single-length) segment 201 are inspected. The multi-length segments 200 and the single-length segments 201 formed therefrom, for example, preferably comprise a susceptor 211, which is designed for induction heating by a corresponding heater.

The machine 1 further comprises in the conveying direction of the segments 201 a feeding unit 3 with three feeding modules 301, 302, 303, the number of which is expandable arbitrarily, a transport line 101, a first wrapping module 4, a further feeding module 5, a second wrapping module 6 and an inspection module 7.

The feeding modules 301, 302, 303 comprise a stock, preferably designed as a hopper, magazine or funnel, a removal drum, a cutting drum, a shifting drum, a staggered drum and a feeding drum. Below the feeding drums of the feeding modules 301, 302, 303, the transport line 101 is designed. The transport line 101 comprises conveyor drums 110, 111, 112, 113, 114, 115, which are designed preferably of the same diameter, the same pitch or particularly preferably identically. The conveyor drums 110, 111, 112, 113, 114, 115 each comprise a cylindrical drum body on which receptacles for rod-shaped articles are disposed in the circumferential direction, in particular receiving troughs, in order to hold and convey the rod-shaped articles.

The single-length article segments 201 disposed side by side in two rows are fed to a feeding unit 3 with individual feeding modules 301, 302 and 303 after the transfer module 2 of a transport line 101. The first feeding module 301 of the feeding unit 3 feeds a second rod-shaped segment 202 to the transport line 101, wherein the segment 202 is preferably designed as a double segment. This is inserted centrally between the two first rod-shaped article segments 201, cut centrally and spaced apart from each other. Upon transfer of the rod-shaped segments 202 from the feeding drum of the feeding module 301 to the conveyor drum 111 of the transport line 101, the rod-shaped segment 202 is combed out of the receptacle of the feeding drum by the conveyor drum 111. The rod-shaped segment 202 is conveyed at a line speed on a feeding drum and combed out of the receptacle of the feeding drum by the receptacle of the conveyor drum 111 at a higher line speed, wherein the rod-shaped segment 202 is conveyed on the conveyor drum 111 at a higher speed.

The second feeding module 302 of the feeding unit 3 provides a third rod-shaped segment 203, which is formed, for example, as cooling segment. This combination of three segments 201, 202, 203 is referred to as segment group 206. The combination of segment groups 206 may preferably incorporate after each insertion of a further segment a tumbling step, that presses the segments of the segment groups together, so that the segments of the segment group make contact on the face side. The segment 203 is cut centrally and rotated by a turning drum or a turning spreading drum and spaced apart from each other.

The further feeding module 303 provides a further segment, a fourth rod-shaped segment 204, and feeds it to the transport line 101 by inserting it centrally between the two segment subgroups of the segment group 206 and forming a segment group 207. The segment group 207 is tumbled, so that the segments contact each other on the face side, and in order to carry out a wrapping of the segment group 207 with the wrapping material 212 in the first wrapping module 4.

After the wrapping operation, segment group 209 has a central double segment and on each side three pairwise identical single-length segments, respectively. Thereupon, segment group 209 is cut centrally and turned by a re-orientation drum, in particular a turning drum or a turning spreading drum, and spaced apart from each other. A further feeding module 5 provides a fifth rod-shaped segment 205 and places it between the two segment subgroups of the segment group 209 and forms the segment group 208. This segment group 208 is likewise tumbled, so that the face sides make contact, and is wrapped in the second wrapping module 6 with a portion of a web-shaped material 213. This forms the segment group 210, which is cut centrally and forms two individual multi-segment articles 220, which are transported side by side in the conveying direction.

A wrapping module 4 is disposed downstream of the feeding modules 301, 302, 303 and the transport line 101 of the feeding unit 3. This wrapping module 4 includes a storage for web-shaped material, a cutting device for dividing the web-shaped material with a knife roller and a suction roller disposed oppositely. The paper strips cut to length and spaced apart are fed to a rolling drum and the segment group 207 is wrapped with the wrapping material 212 and forms a segment group 209. This segment group 209 is divided centrally by a circular knife and turned and spaced apart from one each other by a re-orientation unit, in particular a turning drum, in order to insert a further segment 205, the fifth rod-shaped segment 205. This takes place in the feeding module 5.

A second wrapping module 6 is disposed downstream of the feeding module 5, which may preferably be designed analogously to the wrapping module 4. The wrapping module 6 includes a storage for web-shaped material, which is fed to a rolling drum via a cutting unit and a suction roller. Wrapping material 213 is wound around the segment 205, in order to conjoin this with the other segments. An inspection module 7, which inspects each multi-segment article 220 for its quality properties and transfers it to the subsequent machine, is disposed downstream of the wrapping module 6. After wrapping in the wrapping module 6, the segment group 210 represents a double-length multi-segment article, which is cut centrally and is guided into a single-path article stream by a turning device.

Within the scope of the invention, it is provided that the multi-length segments 200 are transferred from the rod machine 9 to the drum machine 1. Here, it is possible for the rod machine 9 and the drum machine 1 to be disposed linearly behind each other, so that in a straight-ahead arrangement of the rod machine 9 and the drum machine 1, the cut segments 200 are transferred in the rod machine 9 by a transfer drum, the transfer drum having a vertically aligned rotational axis, so that the segments 200 conveyed longitudinally axially in the rod machine 9 are transferred to a transversely axially conveying conveyor drum of the transfer module 2 by the transfer drum. In this case, the transfer drum is configured, for example, with pivotable receiving troughs. For example, such a transfer drum is described in WO 2022/008220 A1, the disclosure of which is expressly incorporated by reference herein in its entirety.

In another embodiment, the drum machine 1 and the rod machine 9 are disposed angled or in an L-shaped arrangement with respect to each other. Here, the longitudinally axially conveyed article segments 200 are transferred in the rod machine 1 on the output side to the drum arrangement of the drum machine 1 by a transfer device, such as a so-called spider, by which the transferred article segments 200 are conveyed in the transverse axial direction within the drum machine 1.

Within the scope of the disclosed embodiments, it is possible, for example, for multiple-length segments 200 to be transferred from the rod machine 9 to the drum machine 1, wherein consecutively, within the drum machine 1, and in particular within the transfer module 2, the multiple-length article segments 200 are cut into single-length segments 201 and, on the output side of the transfer module 2, pairs of two individual and single-length segments 201 disposed side by side in the receiving troughs are transferred to the subsequent units of the drum machine 1. Here, the segments 200 are cut multiple times and, if necessary, conveyed by corresponding staggered drums and/or shifting drums during the conveying of the segments 200 within the transfer module 2.

In addition, it is further possible that, for example, several, in particular two, multiple-length segments 200 are transferred to the transfer module 2, so that subsequently the multiple-length segments 200 are cut into single-length segments 201, wherein a pair of single-length segments 201 are transferred subsequently in each case on the output side of the transfer module 2.

Further, it is possible within the scope of the disclosed embodiments that single-length segments 201 are already transferred from the rod machine 9, so that, in the context of conveying the article segments 201 within the transfer module 2, the article segments 201 are correspondingly grouped in pairs for further processing at the subsequent units of the drum machine 1 by shifting processes and, if necessary, staggering processes within the transfer module 2.

Also, within the scope of the disclosed embodiments, it is provided that single-length article segments 201 are transferred exclusively in pairs from the rod machine 9 to the transfer module 2, so that no cutting of the article segments 201 is necessary during the transverse axial conveying of the segments 201 of the transfer module 2.

Furthermore, in one configuration of the transfer module 2 it is possible that, in the case, in that, for example, the multiple-length segments 200 are designed or are produced with a susceptor 211 designed as a metal band, an alignment of the article segments provided with a metal band is carried out during the conveying of the article segments 200 within the transfer module 2. Here, for example, the individual rod-shaped segments 200 are aligned with respect to cutting knives on a cutting drum or rotated within the receiving troughs of the conveyor drum. Thereby, it is possible, for example, that each individual segment 200 is aligned individually within the receiving trough of the conveyor drum. Moreover, it is also possible that each article segment is rotated by a predetermined angle within the receiving troughs of the conveyor drum, respectively. In case of the individual rotation of the rod-shaped segments 200 within the receiving troughs, it is also provided that in one configuration it is carried out with knowledge of the position of the metal band within the article segment. Alternatively, prior to the rotation of the segments 200, the susceptor 211 formed as a metal band may also be detected at its location with a corresponding sensor, so that the article segment is rotated as a function of the detected location or position of the metal band.

A device for handling rod-shaped articles having magnetic or magnetizable material, in particular a flat metal band, by which rod-shaped articles are aligned within the receiving troughs of a conveyor drum, is described, for example, in the German patent application with the application number 10 2022 101 392.8, the disclosure of which is expressly incorporated by reference herein in its entirety. In one configuration, the alignment of the rod-shaped articles succeeds upstream of a cutting drum preferably relative to the conveying direction of the rod-shaped segments 200 within the transfer module 2.

Figure 2:
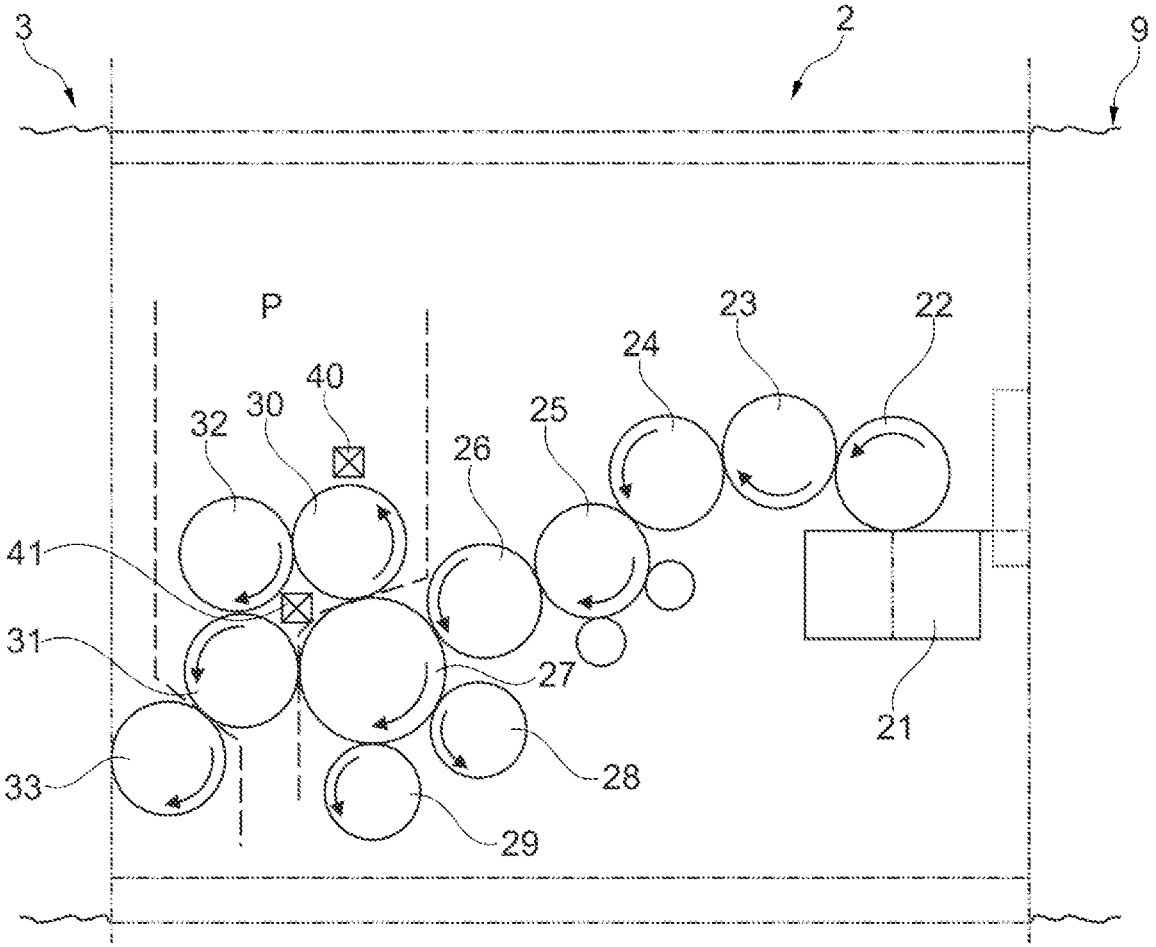
FIG. 2 schematically shows a view of a transfer module according to a first configuration.

In FIG. 2 is shown in a view an exemplary embodiment of a transfer module 2 according to a first exemplary embodiment.

The transfer module 2 on its input side comprises a transfer drum 21 on the output side of the rod machine 9, by which the multiple-length article segments 200 are taken over by the rod machine 9 and are consecutively transferred to a conveyor drum 22. By the transfer drum 21, the multiple-length segments 200 conveyed longitudinally axially in the rod machine 9 are transferred to the conveyor drum 22, on which the multiple-length article segments 200 are conveyed transversely axially.

For transfer, transfer drum 21 is designed with rotatable receiving troughs (not represented). After receiving the transferred article segments 200, the multiple-length article segments 200 are conveyed transversely axially within the transfer module 2. The latter are transferred in the conveying direction of the article segments 200 via further conveyor drums 23, 24 from the conveyor drum 22 to a cutting drum 25.

In one exemplary embodiment, the conveyor drum 22 is designed as an accelerator drum. Further, by way of example, the conveyor drum 23 is designed as a tumbling drum and the subsequent conveyor drum 24, for example, is designed as an orientation drum or alignment drum.

During conveying of the rod-shaped article segments 200, the article segments 200 are cut into single-length article segments 201 by one or more cutting knives or cutting devices on the cutting drum 25. Subsequently, the cut article segments 201 are transferred from the cutting drum 25 to a further conveyor drum 26. After that, the single-length article segments 201 are transferred from the conveyor drum 26 to a staggered feeding drum 27, on which two staggered sliding drums 28, 29 are disposed. From the staggered sliding drums 28, 29, article segments are removed from the staggered feeding drum 27 and transferred back to the staggered feeding drums 27, the pairs of article segments 201 in the receiving troughs of the staggered sliding drum 29 being disposed behind each other in a transverse axial manner in the conveying section after the second staggered sliding drum 29. The conveying of the article segments of single length in pairs by the staggered feeding drum 27 and the staggered sliding drums 28, 29 and the arrangement of pairs of article segments on the staggered feeding drum 27 prior to their transfer to a subsequent conveyor drum are represented, for example, in EP 3 685 684 A1, the disclosure of which is expressly incorporated by reference in its entirety.

From the staggered feeding drum 27, the article segments 201 disposed in pairs of a pair of article segments 201 are each transferred to a subsequent inspection drum 30 or 31 in a conveying inspection section P of the transfer module 2, head end inspection devices 40, 41 for a row of article segments 201 being provided each on the inspection drums 30, 31, by which each of the two face sides or head ends of the article segments 201 are inspected.

By the head end inspection devices 40, 41, for example, the position of the band-like metal segments within the article segments 201 and/or the cutting quality of the face sides of the article segments are monitored. The article segments 201 of a row conveyed on the inspection drum 30 and inspected on the face surfaces are subsequently transferred from the inspection drum 30 to a subsequent conveyor drum 32, wherein the pairs of the article segments 201 are brought together after transfer of the article segments 201 to the inspection drum 31.

Prior to the transfer to the inspection drum 30, 31, pairs of article segments are disposed each in the receiving troughs of the staggered feeding drum 27, the article segments 201 having mutually facing face sides. A row of article segments 201 is transferred to the first inspection drum 31, while the second row of article segments 201 is transferred to the second inspection drum 30. After the inspection of the second row of article segments 201 on the inspection drum 30, these are transferred via a conveyor drum 32 to the inspection drum 31, so that pairs of article segments 201 are formed on the inspection drum 31, which are transferred to a transfer drum 33. The pairs of article segments are subsequently transferred from the transfer drum 33 on the output side to the feeding unit 3.

According to the disclosed embodiments, the face sides of the article segments 201 of the two rows are monitored in the conveying inspection section P independently of each another by the head end inspection devices 40, 41, respectively. Here, each of the article segments 201 are conveyed on different paths from one pair of article segments to one of the inspection drums 30, 31 in order to inspect the individual article segments 201 here. Consecutively, the individual article segments 201 are again brought together to a pair of article segments in the receiving troughs on the further conveyor path on the inspection drum 31 and transferred to the further units of the drum machine 1.

Figure 3A:
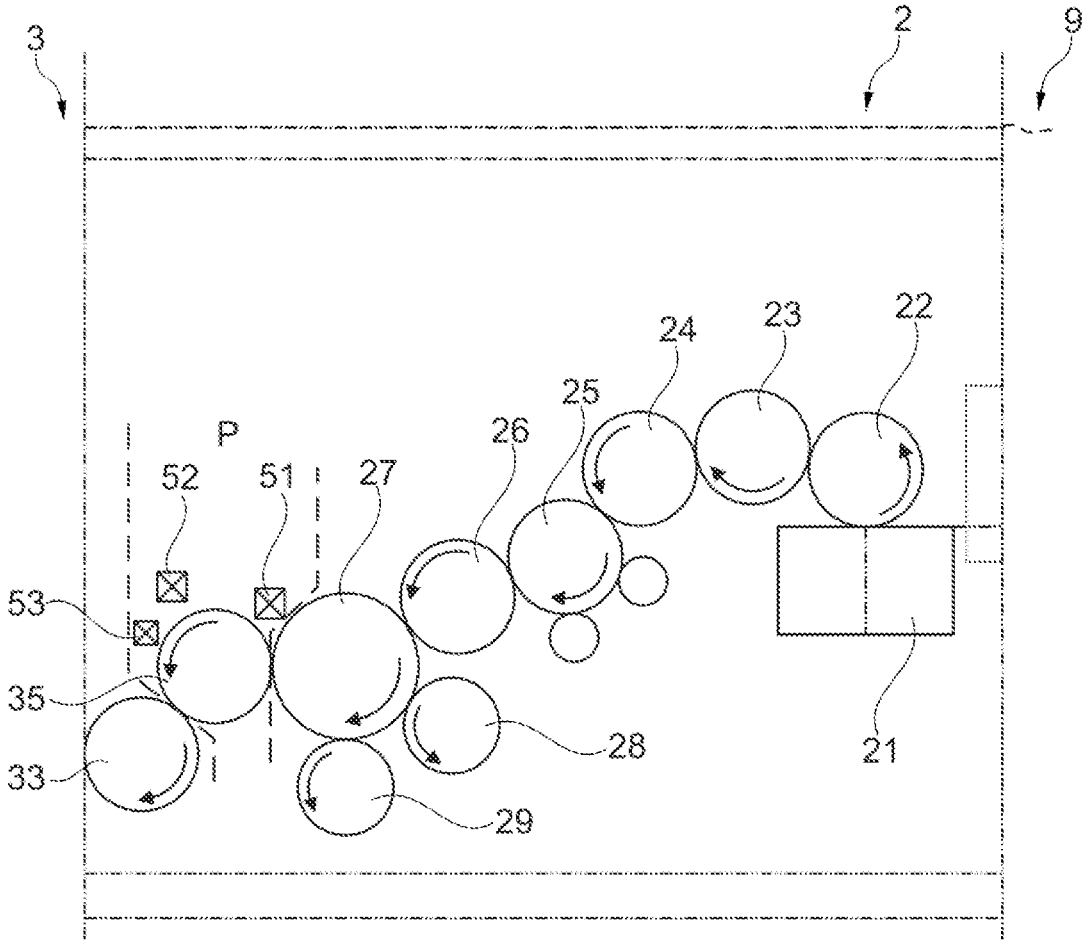
FIG. 3A schematically shows a view of a transfer module according to a further configuration.
Figure 3B:
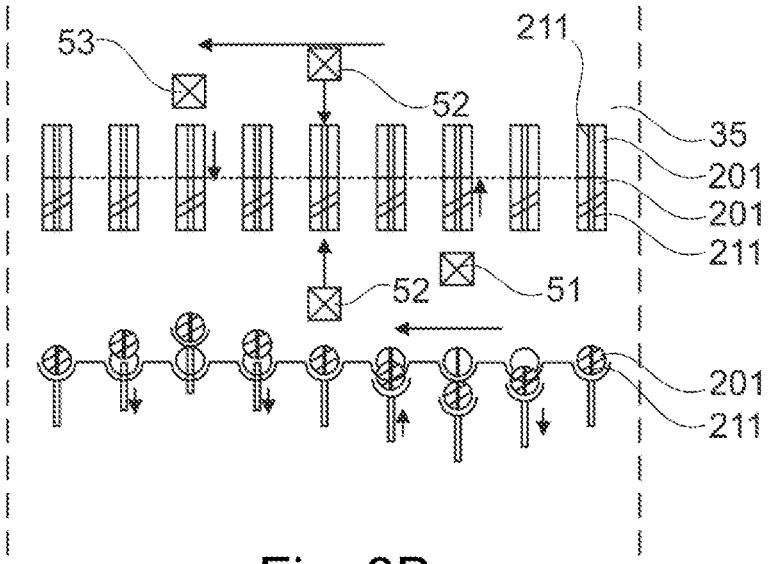
FIG. 3B schematically shows a method for inspecting pairs with single-length segments along their conveyor paths in the transfer module according to FIG. 3A.

In FIG. 3A another exemplary embodiment of a transfer module 2 is shown. Here, with regard to the transfer module 2 shown in FIG. 2, a conveyor drum 35 is disposed after the staggered feeding drum 27 in the conveying direction, on which the pairs of article segments 201 disposed behind each other in the transverse axial direction are transferred from the staggered feeding drum 27 to the conveyor drum 35. Here, the conveyor drum 35 is disposed in a conveying inspection section P. In FIG. 3B, a process flow of the conveying of the article segments 201 on the conveyor drum 35 in a plan view and in a side view is schematically shown. Three head end inspection devices 51, 52, 53 for the inspection of the head ends of article segments 201 are disposed on the conveyor drum 35 designed as inspection drum.

The conveyor drum 35 comprises, in particular, cam-controlled movable tiny arms for the article segments 201, so that the receiving troughs of the conveyor drum 35 execute a stroke path in the radial direction between the reception of the article segments 201 from the staggered feeding drum 27 and the release to the transfer drum 33.

In the exemplary embodiment in FIG. 3A respectively 3B, the article segments 201 provided with hatching are moved back and forth in the radial direction on the conveyor drum 35 during their transverse axial conveying with regard to the other (not hatched) article segments 201. Thereby, the hatched article segments 201 are moved with regard to the article segments of the respective article segment pair. As a result of the hatched (front) article segment 201 being first moved inward toward the rotational axis of the conveyor drum 35 during the conveying from right to left (cf. FIG. 3B), the (rear) non-hatched article segment 201 becomes accessible at the internal face surface to the head end inspection device 51, so that the internal face surface of the corresponding article segment is inspected by the head end inspection device 51.

Subsequently, the hatched article segment 201 is moved outward in the radial direction, so that the article segment pairs with a (hatched) article segment and a (non-hatched) article segment are inspected at the outer head ends respectively face surfaces by the head end inspection device 52. Subsequently, the (hatched) article segment is displaced radially further outward, by which the interior face surface of the (hatched) article segment 201 is accessible to the head end inspection device 53 and thereby the face surface is inspected. Thereafter, the (hatched) article segment 201 is again moved to the radial center of the conveyor drum 35, so that prior to the transfer, the article segment pairs are aligned collinearly with their longitudinal axes in order to be transferred to the subsequent transfer drum 33.

The movement of the article segments 201 on the conveyor drum 35 takes place, for example, by a corresponding cam gear or a corresponding cam control with movable receiving troughs.

Figure 4:
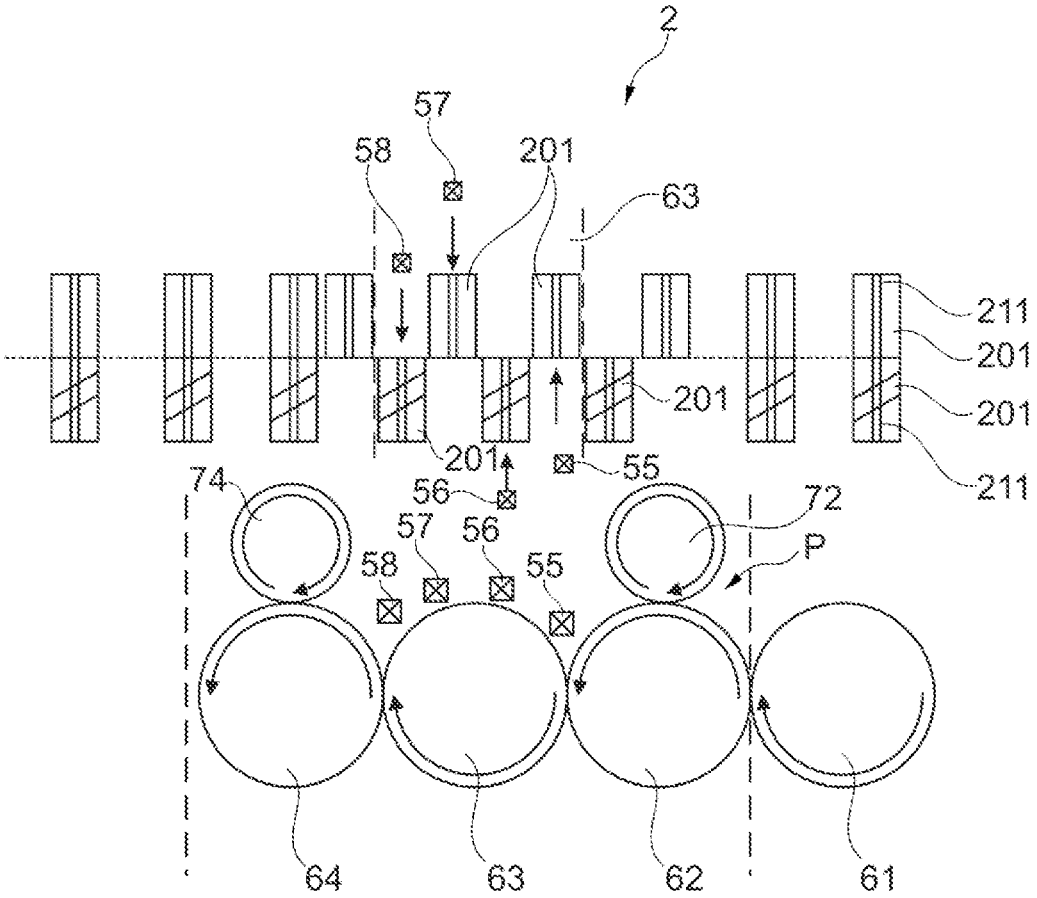
FIG. 4 shows a detail of a conveying inspection section of a transfer module according to a further configuration with a schematically drawn flowchart.

In FIG. 4 is represented furthermore an exemplary embodiment of a conveying inspection section of a transfer module 2. Here, the process flow in the conveying inspection section P is represented schematically in the upper region, while a view of a drum arrangement of the conveying inspection section P is shown in the lower region.

In the conveying inspection section P shown, article segments 201 are transferred in pairs from a conveyor drum 61 to a subsequent conveyor drum 62. A staggered drum 72 is disposed on the conveyor drum 62, by which the article segments 201 are transferred back to the conveyor drum 62 in a staggered manner. Subsequently, the article segments 201 disposed in a staggered manner on the conveyor drum 62 are transferred to an inspection drum 63, on which head end inspection devices 55, 56, 57, 58 are disposed in order to individually inspect in each case one face side of the article segments 201 staggeredly disposed. As a result of the article segments 201 being disposed in a transverse axial and longitudinal axial direction and staggeredly offset in the receiving troughs disposed behind each other of the inspection drum 63, for example, the article segments hatchedly marked are inspected on their face sides by the head end inspection device 56, 58. The non-hatched article segments 201 are monitored or inspected by the head end inspection devices 55, 57.

After the inspection, the inspected staggered article segments 201 are transferred to a conveyor drum 64, on which a staggered drum 74 is disposed, so that the article segments 201 transferred to the staggered drum 74 are staggered and here a back-staggering is carried out, by which the back-staggered article segments 201 are consecutively conveyed further in pairs on the conveyor drum 64.

In a further configuration (not shown here), it is conceivable within the scope of the disclosed embodiments that a conveying inspection section P of the transfer module 2 also comprises a turning spreading drum in order to space apart and at the same time to make accessible to a head end inspection device the mutually facing face sides of a pair of article segments 201 by a turning spreading operation.

Figure 5A:
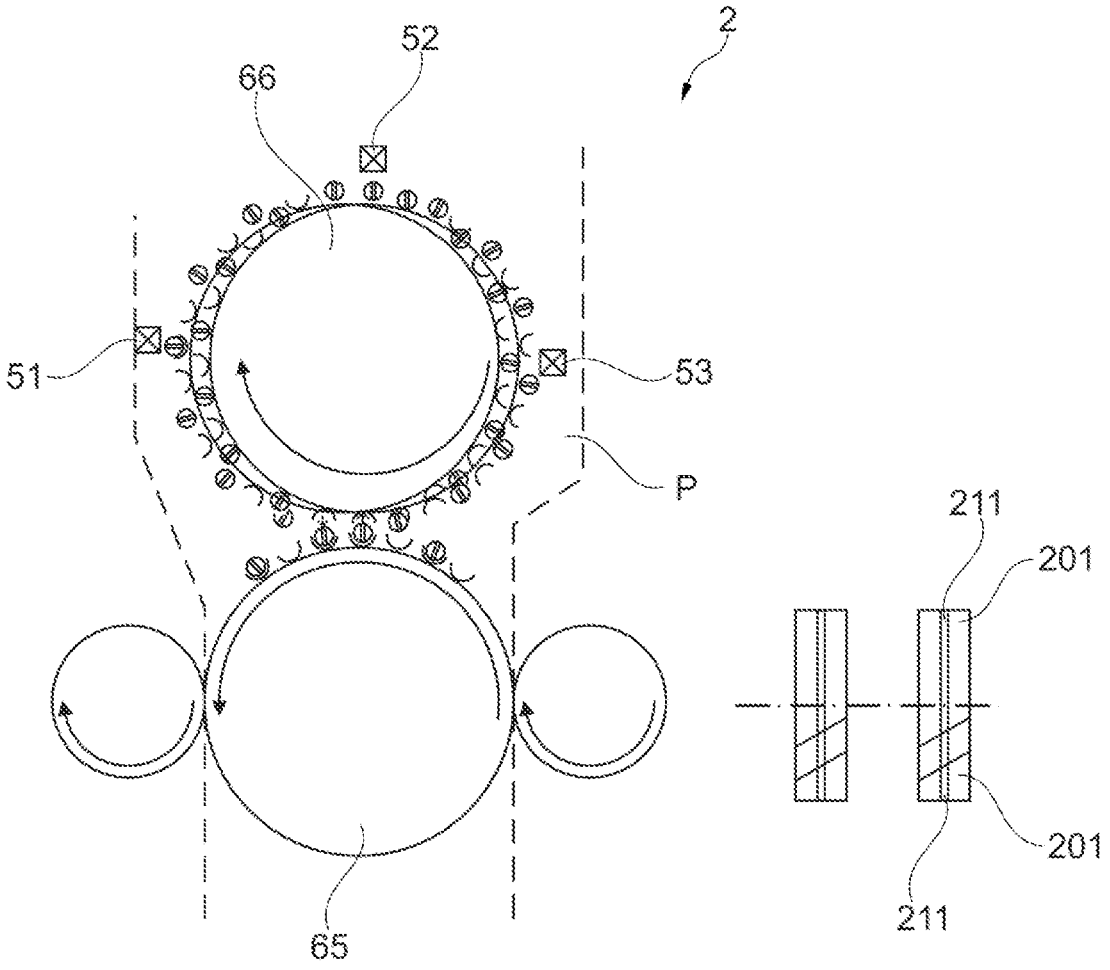
FIG. 5A schematically shows a detail of a transfer module with a further conveying inspection section according to a further configuration.

A further configuration of a conveying inspection section P of a transfer module 2 is represented schematically in FIG. 5A. The conveying inspection section P comprises a conveyor drum 65 having receiving troughs in the circumferential direction. Here, the conveyor drum 65 receives article segments 201 in pairs from an upstream conveyor drum, the transverse axial spacing of the received pairs of article segments 201 being twice as large as the transverse axial spacing of the receiving troughs, so that upon transfer of the received pairs of article segments 201 every second article trough of the conveyor drum 65 is occupied by a pair of article segments 201. Subsequently, the pairs of article segments 201 are transferred to a subsequent conveyor drum 66, which is preferably designed as a path difference drum.

The conveyor drum 66 preferably comprises two offset drum rings or the like with receiving troughs, wherein a drum ring is provided for each article segment of an article segment pair in order to convey the article segments 201 of a pair on different conveyor paths during the rotation of the conveyor drum 66. Here, the drum bodies of the conveyor drum 66 comprise the same transverse axial spacing between the receiving troughs as the receiving troughs of the conveyor drum 66.

Upon reception of the respective article segments 201 of an article segment pair on the conveyor drum 66, the received article segments 201 are each conveyed at a transverse axial spacing in the receiving troughs of the drum rings of the conveyor drum 66 which corresponds to twice the transverse axial spacing of the receiving troughs of the drum rings. Here, the drum bodies comprise staggered axle stitches, so that the article segments 201 of the respective article segment pairs move on different pitch circles. Due to the offset and different pitch circles for the article segments 201, the mutually facing inner sides of the face surfaces of the article segments 201 of an article segment pair are spaced apart from each another, so that an inner side of an article segment 201 is inspected by the head end inspection device 51 disposed on the conveyor drum 66, and subsequently the outer sides of the two article segments 201 are monitored at the head end inspection device 52 disposed on the conveyor drum 66. Subsequently, the face side not yet inspected of an article segment 201 is inspected by the head end inspection device 53 disposed on the conveyor drum 66. Thereafter, the (collinearly aligned) article segments 201 brought together again of an article segment pair are transferred back to the conveyor drum 65.

In an alternative, it is conceivable that the conveyor drum 66 is also designed with pivotable tiny arms for the article segments 201 of an article segment pair, by which, during the conveying of the article segments, the tiny arms are pivoted against each other, for example, by a cam gear or the like, by which the interior face sides of an article segment pair are accessible to a head end inspection device.

In one configuration, one of the conveyor drums 65, 66 comprises an odd number of troughs, while the other conveyor drum comprises an even number of receiving troughs.

Figure 5B:
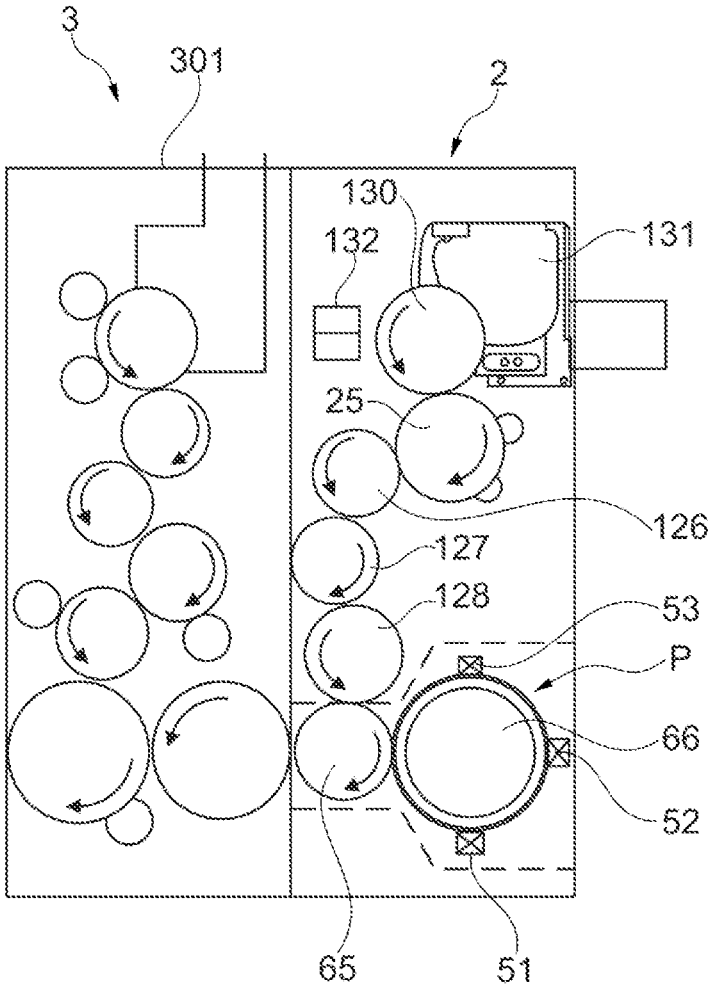
FIG. 5B schematically shows a further exemplary embodiment of a transfer module with a conveying inspection section in combination with a feeding module of a feeding unit.

In FIG. 5B is shown a further exemplary embodiment of a transfer module 2, wherein multiple-length article segments 200 are removed from a magazine 131 by a removal drum 130 and the article segments 200 provided with a metal band are conveyed by an alignment apparatus 132, in particular a magnetic alignment apparatus, disposed on the removal drum 130, whereby the metal bands of the article segments 200 are aligned. Subsequently, the article segments 200 are conveyed to the cutting drum 25. Subsequently, the multiply cut article segments 200 are transferred as single-length article segments 201 to a first staggered drum 126 and subsequently to a second staggered drum 127 and are disposed in a staggered manner by the staggered drum 126, 127 such that pairs of article segments 201 are disposed behind each other in the transverse axial direction. Subsequently, the article segment pairs disposed behind each other in two rows on a subsequent conveyor drum 128 are transferred to the conveyor drum 65. From the conveyor drum 65, the article segment pairs are transferred further to the conveyor drum 66, on which the head end inspection devices 51, 52, 53 are disposed in order to inspect the face sides of the individual article segments 201.

Thereafter, the inspected article segments 201 of the two rows of article segment pairs are transferred back from the conveyor drum 66 to the conveyor drum 65 and subsequently conveyed to the feeding unit 3.

Figure 6:
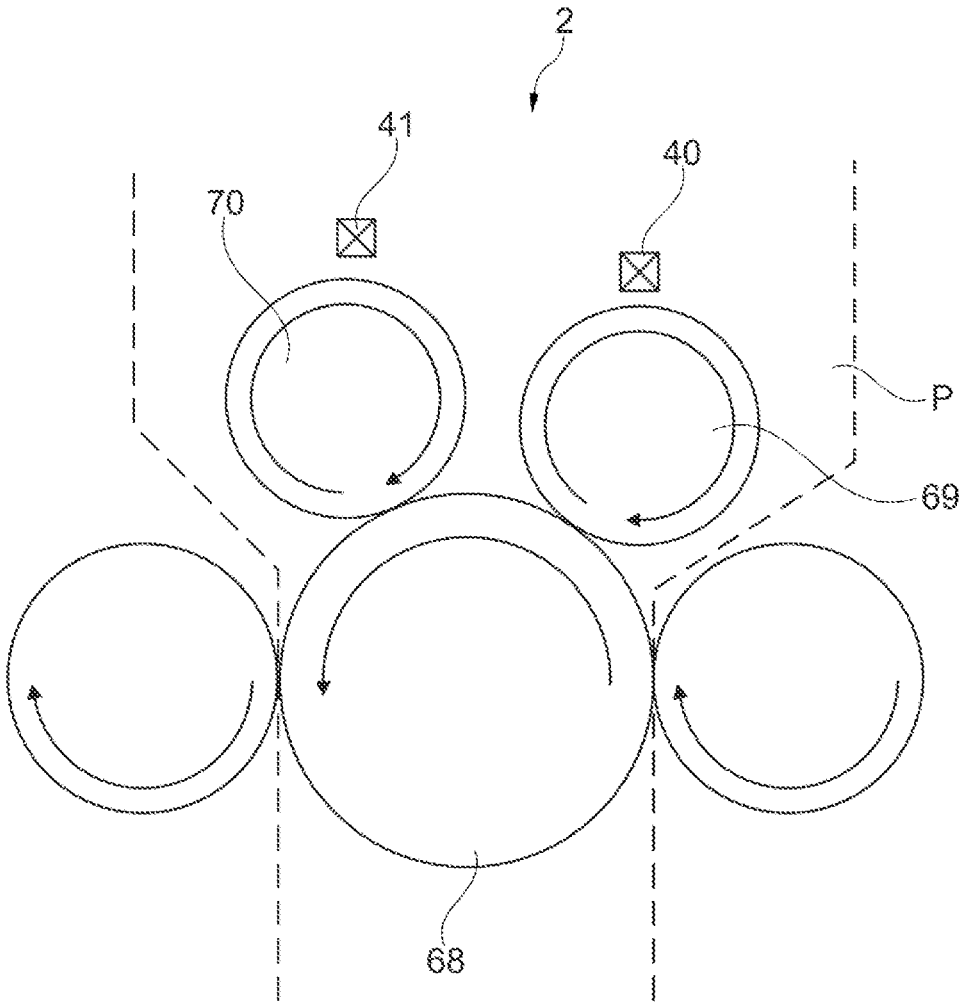
FIG. 6 schematically shows a detail of a transfer module with a conveying inspection section according to further exemplary embodiments.

In FIG. 6 is shown a further exemplary embodiment of a conveying inspection section P for article segments 201 on a transfer module 2. Here, the conveying inspection section P comprises a conveyor drum 68, on which are disposed two inspection drums 69, 70 with head end inspection devices 40, 41 disposed thereon, respectively. An article segment 201 of an article segment pair is taken over by the conveyor drum 68 by the inspection drum 69, while the article segment 201 of the article segment pair remaining on the conveyor drum 68 is conveyed to the inspection drum 70 and transferred thereto. The article segment 201 of an article segment pair received and conveyed by the inspection drum 69 is inspected on both face sides by the head end inspection device 40 and subsequently transferred back to the conveyor drum 68. The article segments 201 conveyed by the inspection drum 70 are likewise inspected on their face sides by the head end inspection device 41 disposed on the inspection drum 70, and subsequently are transferred back to the conveyor drum 68, so that, after that, the article segments 201 are conveyed further in pairs on the conveyor drum 68.

Figure 7:
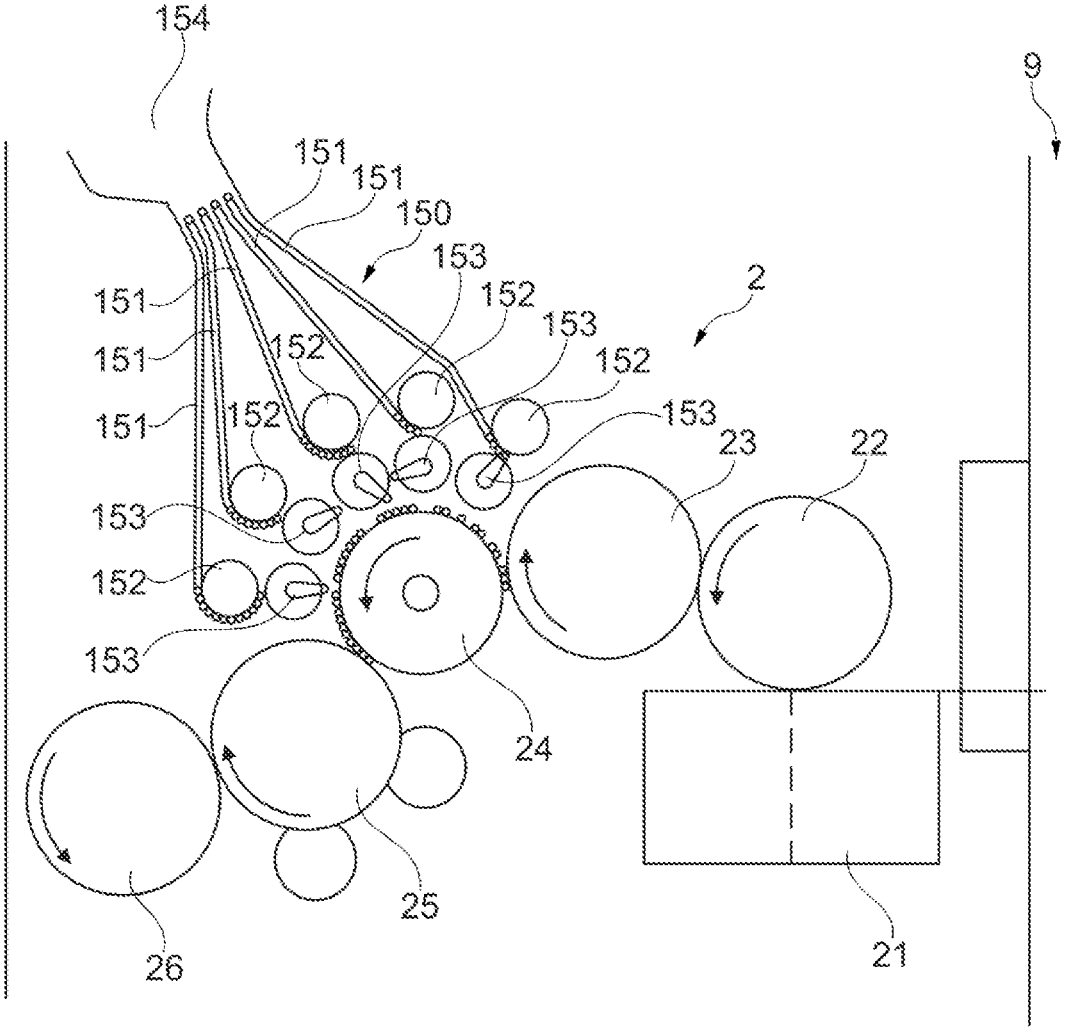
FIG. 7 schematically shows a view of a further transfer module according to a further configuration.

In FIG. 7 another exemplary embodiment of the transfer module 2 is shown in detail. Here, an empty position filling apparatus 150 is provided between the conveyor drum 23 and the cutting drum 25 and the conveyor drum 24, wherein the empty position filling apparatus 150 is designed such that upon detecting empty receiving troughs on the conveyor drum 24 the receiving troughs are filled with rod-shaped article segments. Here, the empty position filling apparatus 150 comprises individual shafts 151 for the article segments, at the end of which a drum 152 is disposed, respectively. Here, drum 152 cooperates with a rotating arm 153, which removes a corresponding article segment from the drum 152 and introduces it by rotation into an (empty) receiving trough of the conveyor drum 24. Upon rotation of the corresponding drum 152, the rod-shaped article segments slide onto the corresponding next free trough of the drum 152. Thereby, a corresponding rod-shaped article segment is gently replenished into an empty trough of the conveyor drum 24.

In the exemplary embodiment in FIG. 7, the shafts 151 are charged from a magazine 154. Alternatively, the shafts 151 may also be filled by a saltire or a mass flow.

Figure 8:
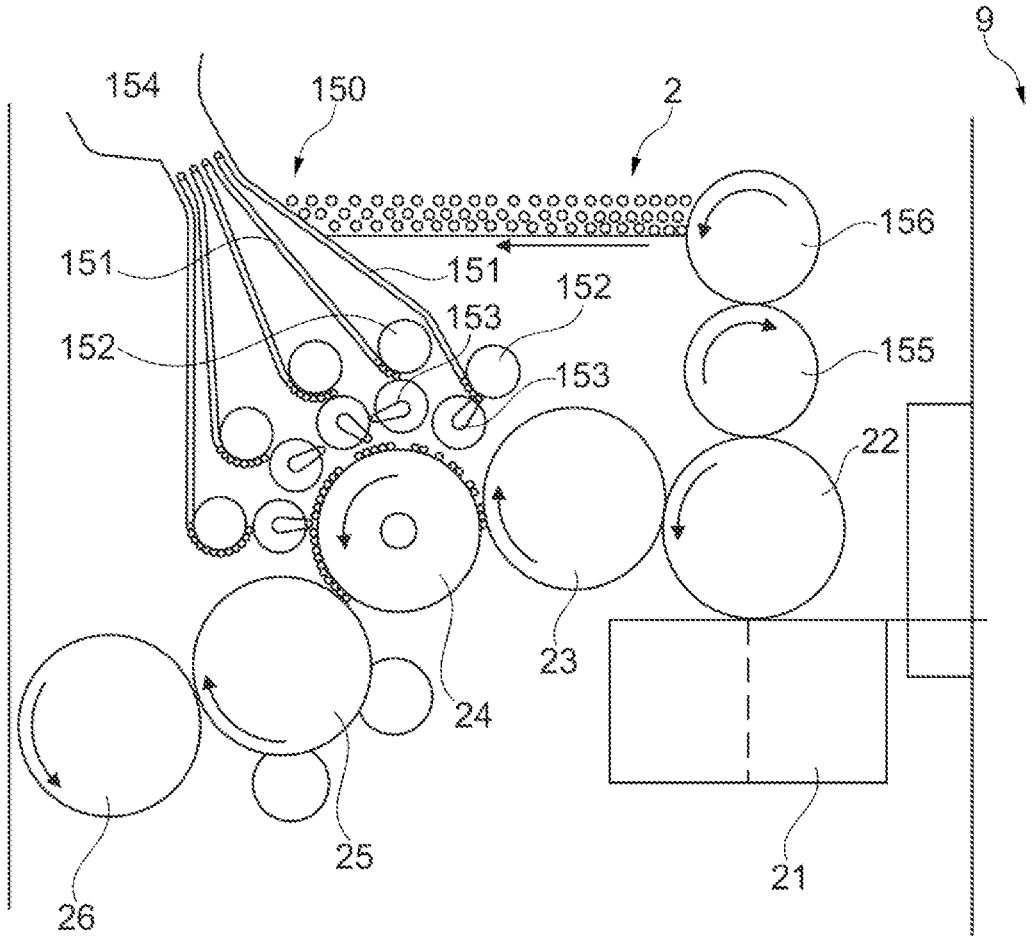
FIG. 8 schematically shows a view of a further exemplary embodiment of a transfer module in detail.

In FIG. 8 a further exemplary embodiment of an empty position filling apparatus 150 is shown. In this exemplary embodiment, for example, the magazine 154 of the empty position filling apparatus 150 is filled prior to start-up of the drum machine 1 (cf. FIG. 1A), in that, for example, prior to production operation, at first, after transfer of the article segments 200 to the conveyor drum 22, the rod-shaped article segments are removed by the conveyor drums 155, 156 and are fed via a mass flow conveyor to the magazine 154 in order to fill the latter.

In production operation, subsequently, the article rods produced by the rod machine 9 are conveyed in a known manner by the transfer drum 21 and subsequently via the conveyor drum 22, 23, 24 to the cutting drum 25.

Figure 9:
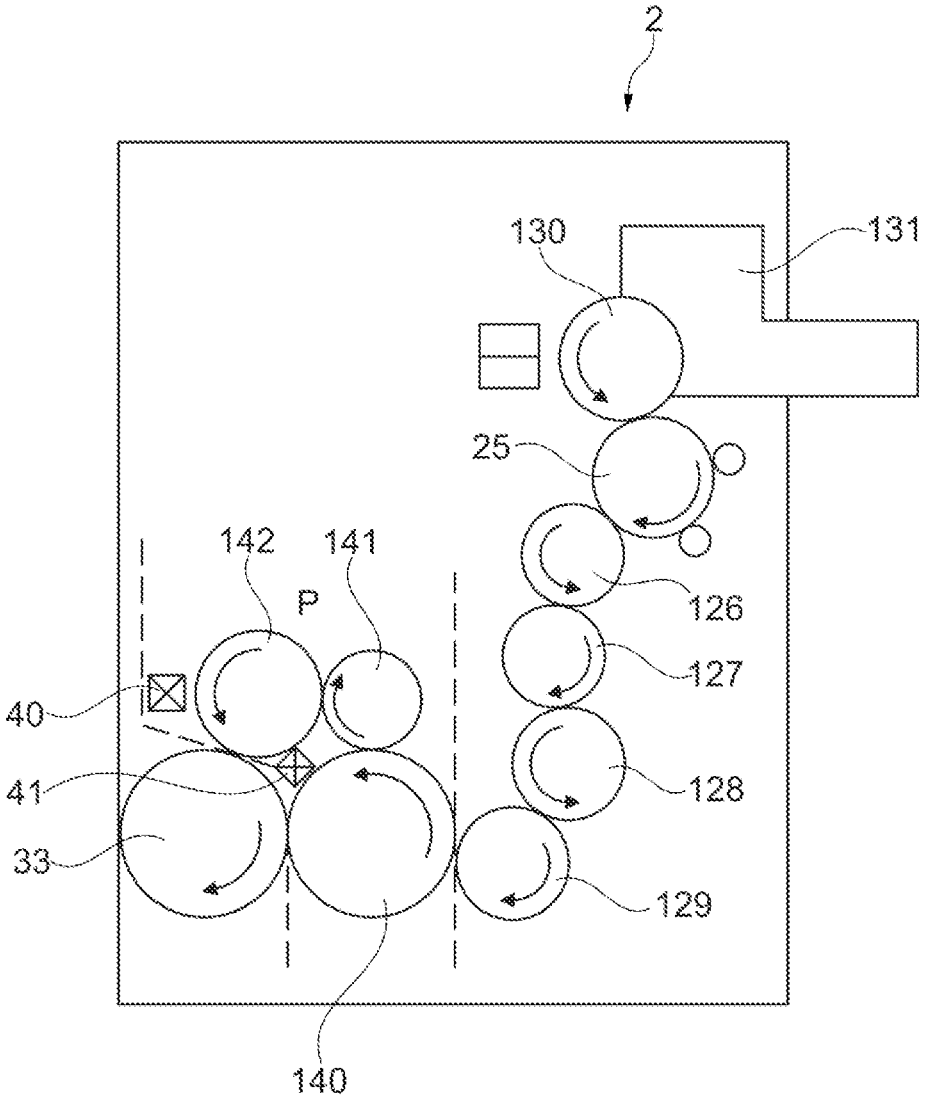
FIG. 9 schematically shows an exemplary embodiment of a further transfer module.

In FIG. 9 a further exemplary embodiment of the transfer module 2 is shown, wherein multiple-length article segments 200 are removed from the magazine 131 by the removal drum 130, which are aligned by the alignment apparatus 132 with respect to the position of a susceptor 211 designed as a metal band. Subsequently, the multiple-length article segments 200 are cut into single-length article segments 201 on the cutting drum 25. Consecutively, the single-length article segments are staggered on the subsequent staggered drums 126, 127 and disposed in pairs transversely axially in succession in a row. The article segments disposed in pairs are consecutively transferred to the conveyor drum 128 and a conveyor drum 129 is consecutively provided in order to transfer the pairs of article segments 201 to the conveyor drum 140. Individual article segments 201 of a row are transferred from the conveyor drum 140 to the conveyor drum 141, while the article segments 201 remaining on the conveyor drum 140 are conveyed further and are inspected from both sides by the head end inspection device 41. The article segments 201 conveyed further by the conveyor drum 141 are transferred from the conveyor drum 141 to a subsequent conveyor drum 142, so that on the conveyor drum 142 the head end inspection device 40 disposed thereon inspects the two face sides of the article segments on the conveyor drum 142 designed as inspection drum. Subsequently, the individual article segments 201 are transferred from the conveyor drum 142 to the transfer drum 33, so that the two article segments 201 of the article segment pairs are brought together again on the transfer drum 33.

All of the cited features, also including those to be taken from the drawings alone, as well as individual features, which are disclosed in combination with other features, are considered alone and in combination as essential to the invention. Embodiments according to the invention may be fulfilled by individual features, or a combination of several features.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE SIGNS

1 Machine
2 Transfer module
3 Feeding unit
4 Wrapping module
5 Feeding module
6 Wrapping module
7 Inspection module
9 Rod machine
21 Transfer drum
22 Conveyor drum
23 Conveyor drum
24 Conveyor drum
25 Cutting drum
26 Conveyor drum
27 Staggered feeding drum
28, 29 Staggered sliding drum
30 Inspection drum
31 Inspection drum
32 Conveyor drum
33 Transfer drum
35 Conveyor drum
40, 41 Head end inspection device
51, 52, 53 Head end inspection device
55, 56, 57, 58 Head end inspection device
61 Conveyor drum
62 Conveyor drum
63 Inspection drum
64 Conveyor drum
65 Conveyor drum
66 Conveyor drum
68 Conveyor drum
69 Inspection drum
70 Inspection drum
72 Staggered drum
74 Staggered drum
101 Transport line
110 Conveyor drum
111 Conveyor drum
112 Conveyor drum
113 Conveyor drum
114 Conveyor drum
115 Conveyor drum
126 Staggered drum
127 Staggered drum
128 Conveyor drum
129 Conveyor drum
130 Removal drum
131 Magazine
132 Alignment apparatus
140 Conveyor drum
141 Conveyor drum
142 Conveyor drum
150 Empty position filling apparatus
151 Shaft
152 Drum
153 Tiny arm
154 Magazine
155 Conveyor drum
156 Conveyor drum
200 Article segment
201 Article segment
202 Segment
203 Segment
204 Segment
205 Segment
206 Segment group
207 Segment group
208 Segment group
209 Segment group
210 Segment group
211 Susceptor
212 Wrapping material
213 Wrapping material
220 Multi-segment article
301 Feeding module
302 Feeding module
303 Feeding module
P Conveying inspection section

What is claimed:

1. An arrangement for transversely axially conveying of rod-shaped articles of the tobacco-processing industry, the arrangement comprising:

a conveying inspection section comprising at least one conveyor drum for conveying a first row of article segments transversely axially disposed behind each other in a transverse axial conveyor direction and for conveying a second row of article segments transversely axially disposed behind each other in the transverse axial conveyor direction, whereby, in the conveying inspection section, the first row of article segments are conveyable along a first conveying path, and the second row of article segments are conveyable along a second conveyor path;

at least one first head end inspection device being arranged along the first conveying path for at least one head end of the first row article segments;

at least one second head end inspection device being arranged along the second conveying path for at least one head end of the second row of article segments; and a further conveyor drum arranged, with respect to the transverse axial conveyor direction, after at least one of the conveying inspection section or the first and second head end inspection devices, wherein the further conveyor drum is configured to convey article segment pairs that each include one first row article segment and one second row article segment.

2. The arrangement according to claim 1, further comprising at least an upstream conveyor drum arranged, with respect to the transverse axial conveyor direction, ahead of a start of the first conveying path and ahead of the start of the second conveying path, at least one upstream conveyor drum being configured to transversely axially convey side by side pairs of article segments, which are assembled of a first row article segment and a second row article segment.

3. The arrangement according to claim 1, wherein, in the conveying inspection section:

the first row of article segments are conveyable on a first conveyor drum and the at least one first head end inspection device for the at least one head end of the first row of article segments is disposed on the first conveyor drum, and the second row of article segments are conveyable on a second conveyor drum and the at least one second head end inspection device for the at least one head end of the second row of article segments is disposed on the second conveyor drum.

4. The arrangement according to claim 3, wherein the at least one first head end inspection device comprises two first head end inspection devices disposed on the first conveyor drum to inspect opposite head ends of the first row of article segments, and wherein the at least one second head end inspection device comprises two second head end inspection devices disposed on the second conveyor drum to inspect opposite head ends of the second row of article segments.

5. The arrangement according to claim 1, further comprising at least one common conveyor drum in the conveying inspection section for the first row of article segments and for the second row of article segments, wherein the at least one common conveyor drum is configured so that, after receiving the side by side pairs of article segments, the first row of the article segments are movable relative to each other and to the second row of article segments, and wherein the least one first head end inspection device is provided on the at least one common conveyor drum.

6. The arrangement according to claim 5, wherein the at least one common conveyor drum is configured so that, after receiving the side by side pairs of article segments, the first row of the article segments are movable relative to each other and to the second row of article segments while maintaining the transverse axial conveying direction.

7. The arrangement according to claim 5, wherein the at least one second head end inspection device comprises two second head end inspection devices and the two second head end inspection devices are provided on the at least one common conveyor drum.

8. The arrangement according to claim 5, wherein the at least one common conveyor drum is configured to move the first row of article segments in at least one of a radial direction or a circumferential direction of the common conveyor drum relative to the second row of article segments.

9. The arrangement according to claim 5, wherein the at least one common conveyor drum has movable arms for the first row of article segments.

10. The arrangement according to claim 9, wherein the movable arms for the first row of article segments are pivotable.

11. The arrangement according to claim 5, wherein the at least one common conveyor drum is designed so that, when conveying the first and second rows of article segments, the first row of article segments and the second row of article segments are spaced apart from each other in the transverse axial direction.

12. The arrangement according to claims 5, wherein the at least one common conveyor drum comprises rotatable receptacles for the first and second rows of article segments, the rotatable receptacles being rotatable about rotational axes oriented radially to the rotational axis of the at least one common conveyor drum.

13. The arrangement according to claim 1, further comprising in the conveying inspection section:

a first staggered drum for the first row of article segments and for the second row of article segments;

a second staggered drum for the first and second rows of article segments disposed in a staggered manner relative to the transverse axial conveying direction of the first and second rows of article segments; and at least one conveyor drum, wherein one of:

at least one of the at least one first head inspection device or the at least one second head inspection device is provided between the first staggered drum and the second staggered drum, or the at least one first head inspection device and the at least one second head inspection device is provided on the at least one conveyor drum.

14. The arrangement according to claim 1, further comprising in the conveying inspection section:

a common conveyor drum on which pairs of article segments are conveyable, wherein each pair of article segments is assembled of a first row article segment and a second row article segment;

a first conveyor drum for the first row of article segments; and a second conveyor drum for the second row of article segments are disposed on the common conveyor drum, wherein the first row of article segments are transferable from the common conveyor drum to the first conveyor drum for further conveyance, wherein head ends of the first row of article segments further conveyed by the first conveyor drum past the at least one first head end inspection devices, which is disposed on the first conveyor drum, for inspection, and wherein, after passing the at least one first head end inspection device, the first row of article segments are transferable to the common conveyor drum, and wherein, with respect to the lateral axial direction, downstream of the first conveyor, the second row of article segments are transferable from the common conveyor drum to the second conveyor drum for further conveyance, wherein head ends of the second row of article segments further conveyed by the second conveyor drum past the at least one second head end inspection device, which is disposed on the second conveyor drum, for inspection, and wherein, after passing the at least one second head end inspection device, the second row of article segments are transferable to the common conveyor drum.

15. The arrangement according to claim 1, wherein the arrangement is designed as a transfer module between a rod machine for manufacturing rod-shaped article segments and a multi-segment article manufacturing machine for manufacturing rod-shaped multi-segment articles of the tobacco-processing industry.

16. The arrangement according to claim 1, wherein the rod-shaped articles of the tobacco processing industry comprise one of filter rods or filter rod segments or segment articles or multi-segment articles.

17. The arrangement according to claim 1, wherein at least one of the at least one first head end inspection device and the at least one second head end inspection device comprises an optical sensor.

18. A method for transversely axially conveying rod-shaped articles of the tobacco-processing industry in the arrangement according to claim 1, the method comprising:

conveying a first row of article segments transversely axially disposed behind each other in a transverse axial conveyor direction along a first conveying path in a conveying inspection section and a second row of article segments transversely axially disposed behind each other in the transverse axial conveyor direction along a second conveyor path in the conveying inspection section, wherein at least one first head end inspection device is arranged along the first conveying path for inspecting at least one head end of the first row article segments and wherein at least one second head end inspection device is arranged along the second conveying path for inspecting at least one head end of the second row of article segments; and downstream of at least one of the conveying inspection section or the at least one first and at least one second head end inspection devices, conveying article segment pairs that each include one first row article segment and one second row article segment.

* * * * *